US009457884B2

(12) United States Patent
Keough

(10) Patent No.: US 9,457,884 B2
(45) Date of Patent: Oct. 4, 2016

(54) POWER PADDLE

(71) Applicant: Gene L. Keough, Klamath Falls, OR (US)

(72) Inventor: Gene L. Keough, Klamath Falls, OR (US)

( * ) Notice: Subject to any disclaimer, the term of this patent is extended or adjusted under 35 U.S.C. 154(b) by 0 days.

(21) Appl. No.: 14/462,292

(22) Filed: Aug. 18, 2014

(65) Prior Publication Data

US 2014/0357139 A1 Dec. 4, 2014

Related U.S. Application Data

(63) Continuation of application No. 14/099,858, filed on Dec. 6, 2013, now Pat. No. 8,808,044.

(60) Provisional application No. 61/740,909, filed on Dec. 21, 2012.

(51) Int. Cl.

| | |
|---|---|
| ***B63H 23/34*** | (2006.01) |
| ***B63H 1/14*** | (2006.01) |
| ***B63H 5/16*** | (2006.01) |
| ***B63H 20/00*** | (2006.01) |
| ***B63H 20/16*** | (2006.01) |
| ***B63H 20/22*** | (2006.01) |
| ***F04D 13/08*** | (2006.01) |
| ***B63H 20/32*** | (2006.01) |
| *B63H 20/14* | (2006.01) |

(52) U.S. Cl.

CPC ..... *B63H 23/34* (2013.01); *B63H 1/14* (2013.01); *B63H 5/165* (2013.01); *B63H 20/007* (2013.01); *B63H 20/16* (2013.01); *B63H 20/22* (2013.01); *B63H 20/32* (2013.01); *F04D 13/08* (2013.01); *B63H 2020/145* (2013.01)

(58) Field of Classification Search

CPC ..... B63H 23/34; B63H 20/14; B63H 20/12; B63H 20/10; B63H 23/321; B63H 20/34; F02B 1/045; F16C 3/03

USPC ..... 440/83, 78, 63, 64, 49; 114/221 R, 222

See application file for complete search history.

(56) References Cited

U.S. PATENT DOCUMENTS

| | | | |
|---|---|---|---|
| 1,703,099 | A | 2/1929 | Craddock |
| 2,799,485 | A | 7/1957 | Silverman |
| 3,333,831 | A | 8/1967 | Chapman |

(Continued)

FOREIGN PATENT DOCUMENTS

| | | | |
|---|---|---|---|
| GB | 710280 | A | 6/1954 |

OTHER PUBLICATIONS

Doug Mahoney, Tool Snob, http://www.toolsnob.com/archives/2011/04/power_tool_blog-a-geddon_volum.php, Apr. 28, 2011, 6 pages.

*Primary Examiner* — Anthony Wiest
(74) *Attorney, Agent, or Firm* — Kolisch Hartwell, P.C.

(57) ABSTRACT

A portable propulsion system for a watercraft may include a shaft, a propeller, an outer casing, and a flexible strap. The shaft may have a prop end section, a drive end section, and a rotational axis extending from the prop end section to the drive end section. The propeller may be connected to the prop end section of the shaft. The drive end section may be configured for removable connection to a driver for rotation of the propeller via rotation of the shaft about the rotational axis to propel the watercraft. The outer casing may be disposed around the shaft. The flexible strap may have first and second end sections connected to the outer casing in respective first and second regions.

6 Claims, 5 Drawing Sheets

(56) References Cited

U.S. PATENT DOCUMENTS

| | | | | |
|---|---|---|---|---|
| 3,498,253 | A | 3/1970 | Wood, Jr. | |
| 4,752,256 | A | 6/1988 | Dorion | |
| 5,013,282 | A | 5/1991 | Keller | |
| 5,802,724 | A | 9/1998 | Rickard et al. | |
| 6,616,489 | B1 | 9/2003 | Dompierre et al. | |
| 6,776,073 | B1 | 8/2004 | Brady et al. | |
| 7,530,340 | B1 | 5/2009 | Jellinek et al. | |
| 8,020,304 | B2 | 9/2011 | Mace et al. | |
| 8,512,086 | B1 * | 8/2013 | Charczuk | B63H 20/007 416/74 |
| 2004/0092176 | A1 | 5/2004 | Allen | |
| 2009/0085406 | A1 | 4/2009 | Gard | |
| 2010/0283020 | A1 | 11/2010 | LaFreniere | |

* cited by examiner 400
404
406
408
426
428

400
412
414
444
448
406
408
404
410
402
426
428
432
431a
431b
430
422
446
402b
440
450
435a
435b
434
437a
437b
402a
416
438
436

POWER PADDLE

CROSS-REFERENCE TO RELATED APPLICATIONS

This application is a continuation of U.S. patent application Ser. No. 14/099,858, filed Dec. 6, 2013, now U.S. Pat. No. 8,808,044 and entitled "Power Paddle", which application claims priority to U.S. Provisional Patent Application Ser. No. 61/740,909, filed Dec. 21, 2012 and entitled "Power Paddle", the disclosures of which are herein incorporated by reference.

INTRODUCTION

The general field of invention relates to portable propelling systems for watercraft, such as a motor system for propelling a small boat.

Prior art propelling systems exist which include a trolling motor powered by a relatively heavy 12-volt marine battery. However, these prior art systems typically require at least semi-permanent installation of the system on the watercraft, are relatively expensive, are not water-buoyant, are not very portable, are not selectively towable behind the watercraft, and are not suitable for propelling small watercraft such as inflatable kayaks, personal inflatable tubes, or single-person pontoon rafts.

SUMMARY

In one example, a portable propulsion system for a watercraft may include a shaft, a driver, a propeller, an outer casing, and a flexible strap. The shaft may have a prop end section, a drive end section, and a rotational axis extending from the prop end section to the drive end section. The propeller may be associated with the shaft and connected to the prop end section. The drive end section may be configured for removable connection to the driver to facilitate rotation of the propeller via rotation of the shaft about the rotational axis to propel the watercraft. The outer casing may be disposed around the shaft. The flexible strap may have first and second end sections. The first end section may be connectable to the outer casing in a first region distal the drive end section of the shaft. The second end section may be coupled to the outer casing in a second region proximal the drive end section of the shaft.

In another example, a portable propulsion system for a watercraft may include a shaft, a propeller, an outer casing, and a flexible strap. The shaft may have a prop end section, a drive end section, and a rotational axis extending from the prop end section to the drive end section. The propeller may be connected to the prop end section of the shaft. The drive end section may be configured for removable connection to a driver for rotation of the propeller via rotation of the shaft about the rotational axis to propel the watercraft. The outer casing may be disposed around the shaft. The flexible strap may have first and second end sections connected to the outer casing in respective first and second regions.

DETAILED DESCRIPTION

Examples of a portable propulsion system for a watercraft, according to aspects of the present disclosure are shown in FIGS. 1-11. Unless otherwise specified, a portable propulsion system may, but is not required to, contain at least one of the structure, components, functionality, and/or variations described, illustrated, and/or incorporated herein.

Figure 1:
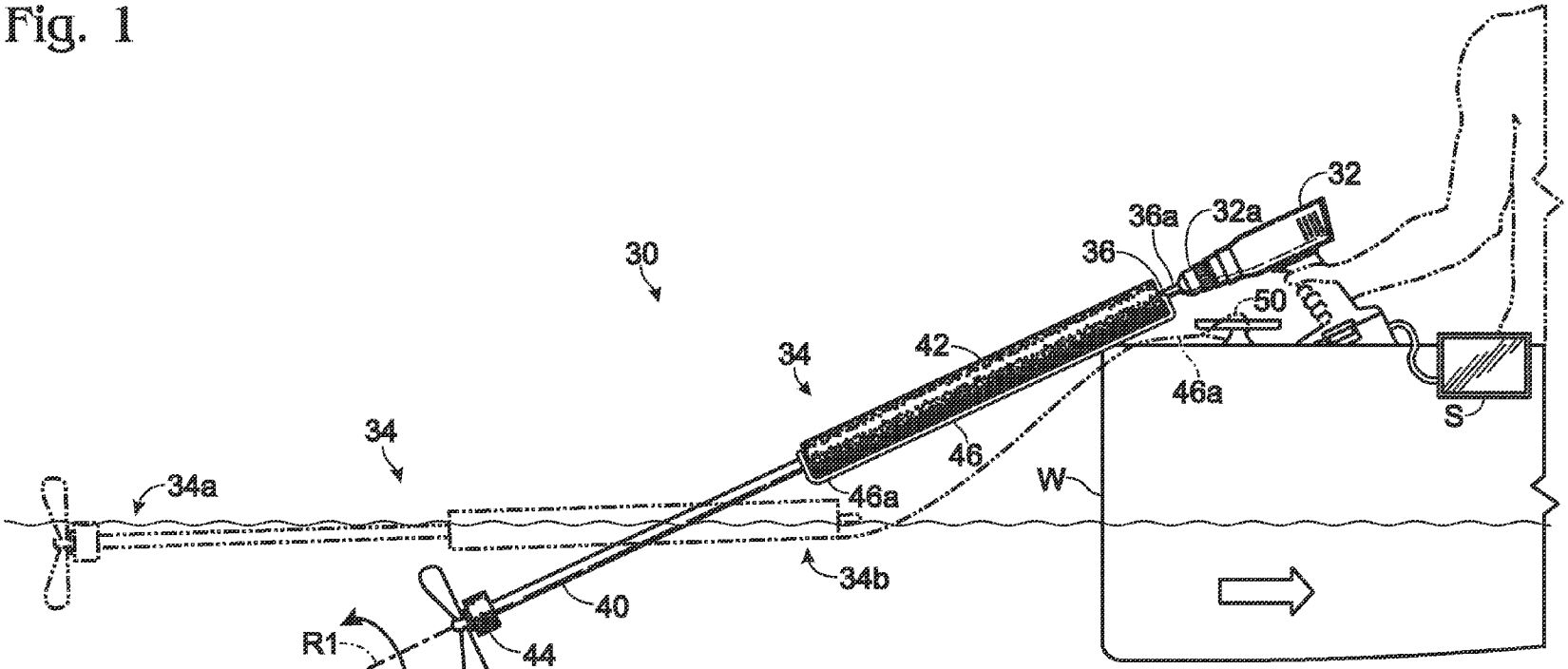
FIG. 1 is an elevation view of an embodiment of a portable propulsion system for a watercraft, according to aspects of the present disclosure.

FIG. 1 shows a portable propulsion system, generally indicated at 30, for a watercraft W. Watercraft W may be any suitable watercraft, such as a boat, a canoe, a kayak, an inflatable kayak, an inflatable raft, or an inflatable tube. As shown, system 30 includes a driver 32 and a propeller apparatus, generally indicated at 34, which includes a shaft 36, a propeller 38, an outer casing 40, a first component 42, a second component 44, and a strap 46.

Driver 32 may be configured to rotate propeller 38 via rotation of shaft 36 to propel watercraft W. For example, a user may removably connect driver 32 to a drive end portion 36*a* of shaft 36 (e.g., by tightening a chuck 32*a* of driver 32 onto drive end portion 36*a*). A prop end portion 36*b* (see FIG. 2) of shaft 36 may be connected to propeller 38. The user may selectively operate driver 32 to rotate shaft 36 about a rotational axis R1 of shaft 36. Rotation of shaft 36 about axis R1 may be configured to rotate propeller 38 about axis R1 to propel watercraft W (e.g., by displacing water).

Driver 32 may be a drill that is portable, electric, handheld, and/or cordless, and may include a battery and/or may be coupled to a portable solar panel S, as shown in FIG. 1. For example, solar panel S may be coupled to a power supply of the driver, such as to the battery of the driver.

In some embodiments, the driver may be a line trimmer power-head (e.g., a portion of a string trimmer that provides rotation) that may be gas powered and/or may have a rechargeable electric power supply.

Shaft 36 may be made of any suitable material and may have any suitable dimensions. For example, shaft 36 may be made of cold-rolled steel or aluminum, and may have an approximate diameter of ⅜ of an inch and an approximate length in a range of about 48 to 72 inches. In some embodiments, shaft 36 may be longer than 72 inches or shorter than 48 inches.

Propeller 38 may include any suitable apparatus for displacing matter. For example, propeller 38 may be a MINN KOTA MKP-2 propeller, or a WATERSNAKE® 2-bladed propeller (part no. 55131).

Outer casing 40 may be made of any suitable material and may have any suitable dimensions. For example, outer casing 40 may be a section of pipe made of PVC having an approximate diameter of ½ of an inch and a length in a range of about 44 to 68 inches. In some embodiments, outer casing 40 may be longer than 68 inches or shorter than 44 inches.

Outer casing 40 may be disposed around shaft 36 between drive end portion 36*a* and the prop end portion 36*b* of shaft 36. In other words, shaft 36 may extend through outer casing 40, and opposing end portions 36*a* and 36*b* of shaft 36 may protrude through opposing ends of outer casing 40. Shaft 36 may be configured to rotate about rotational axis R1 relative to outer casing 40.

First and second components 42 and 44 may be made of a compressible and/or buoyant (e.g., water-buoyant) material. For example, first and second components 42 and 44 may be made of a polymeric and/or closed-cell foam (e.g., ½ inch pipe wrap, or one or more sections of foam tubing, such as one or more "pool-noodles"). A level of buoyancy provided by first and second components 42 and 44 may be such that if system 30 (or a portion thereof, such as apparatus 34) is dropped in the water, system 30 (or apparatus 34) will float to the surface of the water, thus reducing the likelihood that the user will lose system 30 (or apparatus 34). First and second components 42 and 44 may be an outer cover of outer casing 40, may be connected to a portion of outer casing 40, and/or may be integrally formed with outer casing 40.

Figure 2:
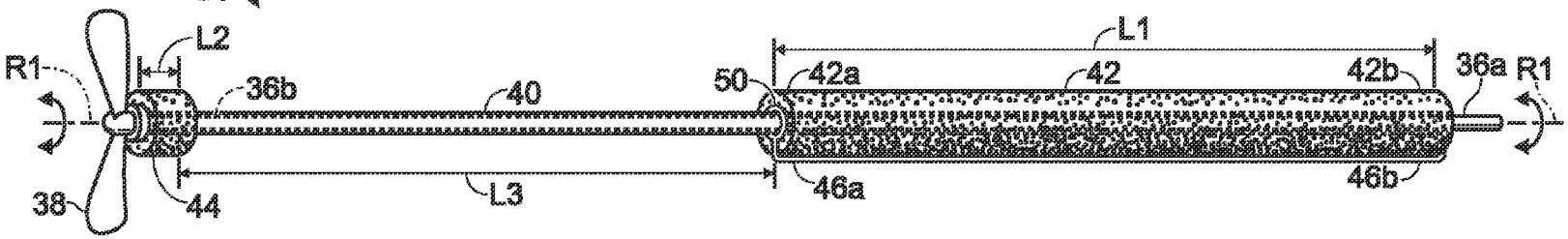
FIG. 2 is an isometric view of a propeller apparatus of the portable propulsion system of FIG. 1.

As shown in FIG. 2, first component 42 may be disposed around shaft 36 between prop and drive end portions 36*a* and 36*b* of the shaft. For example, first component 42 may be disposed around an exterior perimeter of outer casing 40 in a region proximal drive end portion 36*a* of shaft 36. As shown, first component 42 may extend from the region proximal the drive end portion to a region substantially centrally disposed between drive and prop end portions 36*a* and 36*b* of shaft 36.

Second component 44 may be disposed around shaft 36 between first and second ends of shaft 36. For example, second component 42 may be disposed around an exterior perimeter of outer casing 40 in a region proximal prop end portion 36*b* of shaft 36, as shown.

Second component 44 may be a compressible component and/or a buoyant (e.g., water-buoyant) component. For example, second component 44 may be may be a second wrap made of a polymeric closed-cell foam similar to the polymeric closed-cell foam of first component 42.

As shown, first component 42 and second component 44 are respective first and second discrete portions of the polymeric closed-cell foam, with first component 42 having a length L1, and second component having a length L2. The respective first and second discrete portions of first and second components 42 and 44 may be separated by a gap having a length L3. As shown, length L2 is substantially shorter than length L3, and length L1 is substantially equal to length L3.

In some embodiments, a portion of first component 42 may be submerged in the water when system 30 is being used to propel watercraft W. For example, first and second components 42 and 44 separated by the gap having length L3 may allow for apparatus 34 (e.g., as a whole) to be water buoyant, and for propeller 38 and the portion of first component 42 to be completely submerged in the water without the user having to apply downward pressure (or excessive downward pressure) on apparatus 34.

In some embodiments, first component 42 may extend from a region proximal prop end portion 36*a* to a region proximal drive end portion 36*b*, in which case apparatus 34 may be relatively highly (or excessively) water-buoyant, which may be desirable in some embodiments and undesirable in others. For example, this excessive buoyancy may require the user to apply substantial downward pressure on propeller 38 in order to completely submerge propeller 38 in the water, which may be desirable in a relatively shallow water application, but may not be desirable in a relatively deep water application.

However, applicant has discovered that first component 42 extending from a region proximal drive end portion 36*a* to a region substantially centrally disposed between drive end portion 36*a* and prop end portion 36*b* (and/or separating first and second components 42 and 44 by the gap) provides for both water-buoyancy of apparatus 34 and for propeller 38 to be easily submerged.

System 30 may be configured to allow selective maneuverability of watercraft W. For example, outer casing 40 and/or first component 42 disposed around shaft 36 may provide a non-rotating surface in a region corresponding to a rotating portion of shaft 36, which the user (and/or watercraft W) may grip without hindering the rotation of shaft 36, allowing the user to pivot propeller 38 side-to-side and up-and-down in the water, as well as out of the water, while shaft 36 is rotating.

Strap 46 may be a flexible strap. For example, strap 46 may be a length of nylon rope, or other suitable flexible material. In some embodiments, strap 46 may be made of a glow in the dark material.

As shown in FIGS. 1 and 2, strap 46 has a first end portion 46*a* and a second end portion 46*b*. First end portion 46*a* may be connectable to outer casing 40 in a first region distal drive end portion 36*a* of shaft 36. For example, first end portion 46*a* may be formed into an adjustable loop 50 (see FIGS. 2 and 3). The user may selectively tighten adjustable loop 50 around outer casing 40 (see FIG. 2), and may tuck (or dispose) tightened adjustable loop 50 between outer casing 40 and a first edge portion 42*a* of first component 42. Second end portion 46*b* of strap 46 may be coupled to outer casing 40 in a second region proximal drive end portion 36*a* of shaft 36. For example, second end portion 46*b* may be tied around outer casing 40; second end portion 46*b* may include a loop 63, and loop 63 may be disposed around outer casing 40; second end portion 46*b* may be sandwiched between outer casing 40 and a second edge region 42*b* of first component 42; and/or second end portion 46*b* may be connected to first component 42.

As shown in FIG. 1, first end portion 46*a* of strap 46 may be operable between a connected position (e.g., shown in solid lines) and a towing position (e.g., shown in dash double dot lines).

The connected position may correspond to first end portion 46*a* of strap 46 connected to outer casing 40 in the first region to form a circuit. The circuit may include a length of strap 46 and a portion of first component 42 and/or outer casing 40.

In the connected position, the user may use the circuit to carry apparatus 34. For example, the user may insert their arm through the circuit (e.g., between strap 46 and first component 42) and position the circuit around their shoulder (e.g., when transporting apparatus 34 from land into watercraft W).

The towing position may correspond to first end portion 46*a* disconnected from outer casing 40 in the first region and removably coupled to watercraft W. For example, the user may remove driver 32 from drive end portion 36*a* of shaft 36 (e.g., by loosening chuck 32*a*). The user may pull second end portion 46*a* out from between outer casing 40 and first component 42. The user may loosen adjustable loop 50 formed in first end portion 46*a* of strap 46. The user may slide loosened adjustable loop 50 over first component 42, and over and off of prop end portion 36*a*. The user may removably couple loop 50 to watercraft W (e.g., to a cleat or other suitable structure of watercraft W), and may allow apparatus 34 to float and/or be towed behind watercraft W.

As shown in FIG. 1, when in the towing position, a drive end of apparatus 34, generally indicated at 34*a*, may be more buoyant than a propeller end of apparatus 34, generally indicated 34*b*. For example, second component 44 having a shorter length than first component 42 may result in propeller end 34*b* being less water-buoyant than drive end 34*b*.

In some embodiments, loop 50 may be connected to watercraft W when driver 32 is connected to shaft 36, which may prevent system 30 from being inadvertently separated from watercraft W (e.g., if system 30 is inadvertently dropped in the water).

In some embodiments, first component 42 may have a relatively soft outer surface configured to prevent apparatus 34 from scratching watercraft W.

In some embodiments, the first and second components may include one or more sections of one or more pool-noodles, an item which is available in a wide variety of colors, easy to cut, and relatively inexpensive. First component 42 and/or second component 44 may be easily adaptable and/or interchangeable with other sections of pool-noodles to allow the user to match a color, length, and/or configuration of the first and/or second components to a specific application. For example, if the watercraft is blue, then the user may desire to dispose a blue first component on the portable propulsion system. If, for example, the user desires the portable propulsion system to be temporarily less water-buoyant, then the user may desire to dispose shorter lengths of the first and/or second components on the outer casing (or remove the first and/or second components altogether).

Figure 3:
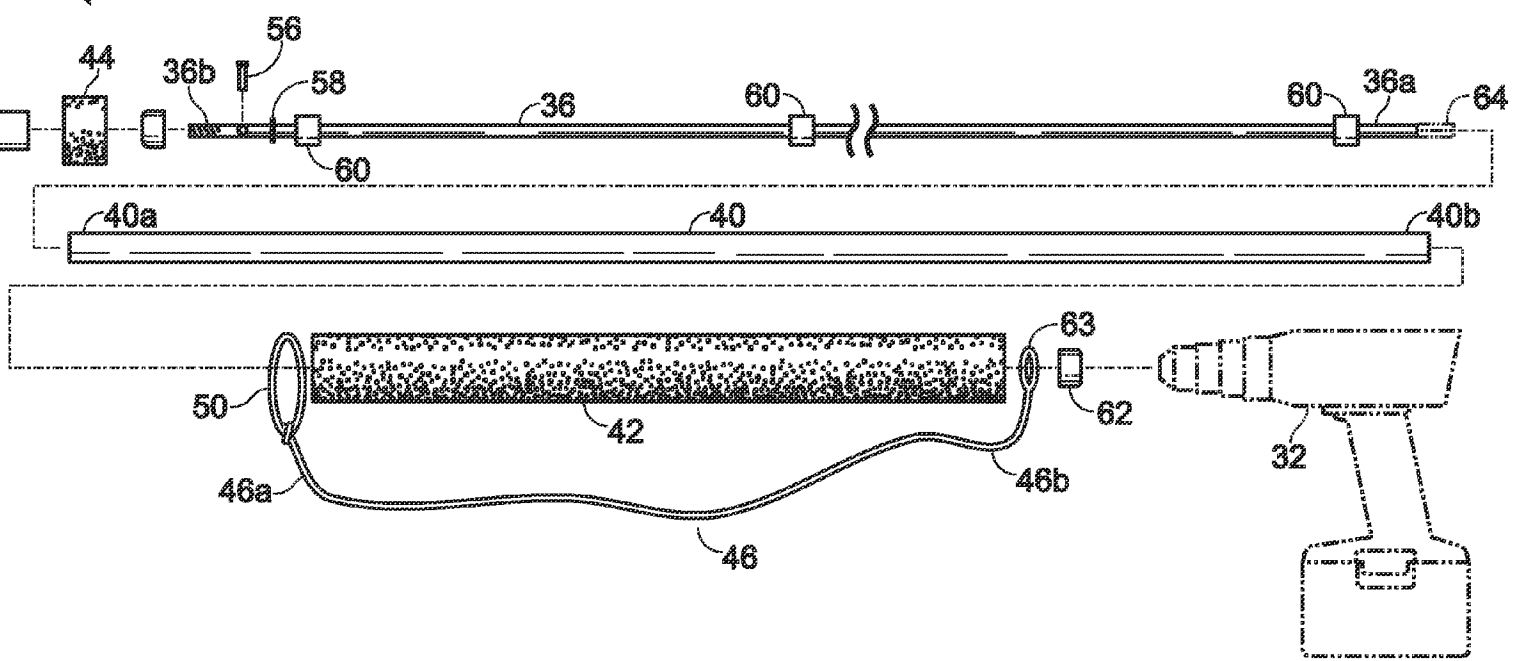
FIG. 3 is a partially exploded view of the portable propulsion system of FIG. 1.

FIG. 3 shows system 30 partially exploded. As shown, system 30 may include an attachment member 52, an end cap 54 secured to an end portion 40*a* of outer casing 40, a pin 56, a water fitting 58, one or more bushings 60, and an end cap 62 secured to an end 40*b* of outer casing 40.

System 30 may include any suitable structure, mechanism, or apparatus configured to operatively connect propeller 38 to shaft 36. For example, prop end portion 36*b* of shaft 36 may extend through propeller 38 and be threaded into attachment member 52 (e.g., a cap, nut, wingnut, or other suitable member). Pin 56 be secured in an aperture in prop end portion 36*b*, and may be seated in a groove of propeller 38 to press propeller 38 against attachment member 52 and fixedly secure propeller 38 relative to shaft 36. One or more bushings 60 may be connected to shaft 36, and may be configured to prevent shaft 36 from contacting outer casing 40.

System 30 may include any suitable structure, mechanism, or apparatus configured to reduce an intrusion of water into outer casing 40 and/or retain shaft 36 in outer casing 40. For example, water fitting 58 may be coupled to a notched portion of shaft 36 and disposed inside outer casing 40. Water fitting 58 may be made of brass, or any other suitable material. Prop and drive end portions 36*b* and 36*a* of shaft 36 may respectively extend through correspondingly shaped openings or holes in end caps 54 and 62 secured to opposite ends 40*a* and 40*b* of outer casing 40. End caps 54 and 62 may be made of PVC. Hardware or other suitable apparatus, such as one or more sections of poly tubing or one or more washers secured by one or more pins, may be coupled to drive end portion 36*a* to prevent drive end portion 36*a* from sliding completely into outer casing 40, and may be coupled to prop end portion 36*b* to prevent prop end portion 36*b* from sliding completely into outer casing 40.

End cap 62 may be dimensioned to have a larger diameter than loop 63 to prevent second end portion 46*b* of strap 46 from being disconnected from outer casing 40 (e.g., to prevent loop 63 from sliding off of outer casing 40). In some embodiments, first component 42 may be disposed over cap 62 to reduce a likelihood that loop 63 may become disengaged from outer casing 40.

In some embodiments, drive end portion 36*a* of shaft 36 may include a non-circular end 64 to provide for an increased frictional engagement between shaft 36 and driver 32. In some embodiments, non-circular end 64 may be dimensioned to accommodate a driver including a line trimmer power-head (e.g., from a weed whacker). For example, non-circular end 64 may be dimensioned to have an approximate square cross-sectional shape of approximately 3/16 of an inch by 3/16 of an inch.

In some embodiments, drive end portion 36*a* of shaft 36 may include a section of material having a higher coefficient of friction than the material of shaft 36. For example, the section of material may be a section of poly tubing disposed over drive end portion 36*a* to increase a frictional/torsional engagement of driver 32 and drive end portion 36*a*.

Figure 4:
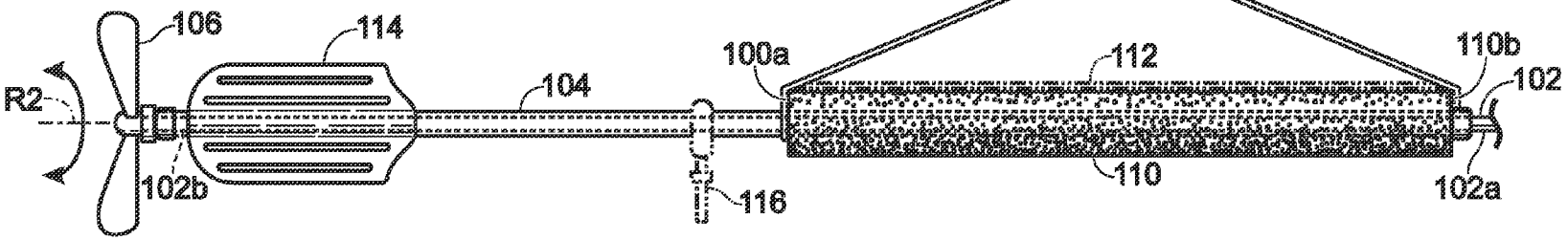
FIG. 4 is an elevation view of an embodiment of a portable propulsion system including an oar outer casing.

FIG. 4 shows an embodiment of a portable propulsion system, generally indicated at 100, according to aspects of the present disclosure. System 100 may include a shaft 102, an outer casing 104, a propeller 106, a first component 110, and a strap 112.

Shaft 102 may be operatively connected to propeller 106 to rotate propeller 106 about rotational axis R2. For example, a drive end portion 102*a* may be configured to receive a driver, such as a line trimmer power-head or a portable cordless electric drill. Rotational axis R2 of shaft 102 may extend from drive end portion 102*a* toward prop end portion 102*b* of shaft 102. Prop end portion 102*b* may be substantially fixedly secured to propeller 106, such that rotation of shaft 102 (e.g., induced by the driver) results in rotation of propeller 106 about rotational axis R2. Rotation of propeller 106 may be configured to propel a watercraft (e.g., by displacing water).

As shown in FIG. 4, outer casing 104 is an oar having an oar head 114, and shaft 102 extends through the oar. In some embodiments, the user may selectively propel the watercraft by rowing with the oar and/or through rotation of propeller 106. For example, if a power source (e.g., an electric change in a battery, or gas in a tank) of the driver becomes depleted, the user may use system 100 as a conventional oar to propel the watercraft. The user may insert oar head 114 into the water, and paddle the watercraft back to shore. In some embodiments, outer casing 104 may include (or be connectable) to an oar lock 116 configured to pivotally couple system 100 to the watercraft.

More than one system 100 may be connected to the watercraft. For example, a first system 100 may be connected to a port side of the watercraft, and a second system 100 may be connected to an opposing starboard side of the watercraft, such that both systems may be used to propel the watercraft through selective rowing and/or rotation of the propellers.

First component 110 and strap 112 of system 100 may be similar to first component 42 and strap 46 of system 30 (see FIGS. 1-3), for example in structure and/or operation. As shown in FIG. 4, strap 112 may be operable between a wide-circuit position (shown in solid lines) and a narrow-circuit position (shown in dash double dot lines), when in the connected position for example. The wide-circuit position may correspond to strap 112 pulled away from a central portion of first component 112 to widen a width of a circuit formed in system 100. The narrow-circuit position may correspond to strap 112 pressing against (or proximal) the central portion of first component 110 to narrow the width of the circuit formed in system 100.

In both the wide-circuit and narrow-circuit positions, strap 112 may press against first component 110. For example, strap 112 may press against opposing end portions 110*a* and 110*b* of first component 110 in the wide-circuit position (and in the narrow-circuit position), which may create a restorative force to bias strap 112 toward the narrow-circuit position. In the narrow-circuit position, strap 112 may press against a majority of a length of first component 110.

Strap 46 of system 30 (see FIGS. 1-3) may operate similar to strap 112 of system 100. For example, strap 46 may be operable between the wide-circuit and narrow-circuit positions.

Figures 5, 6, 7:
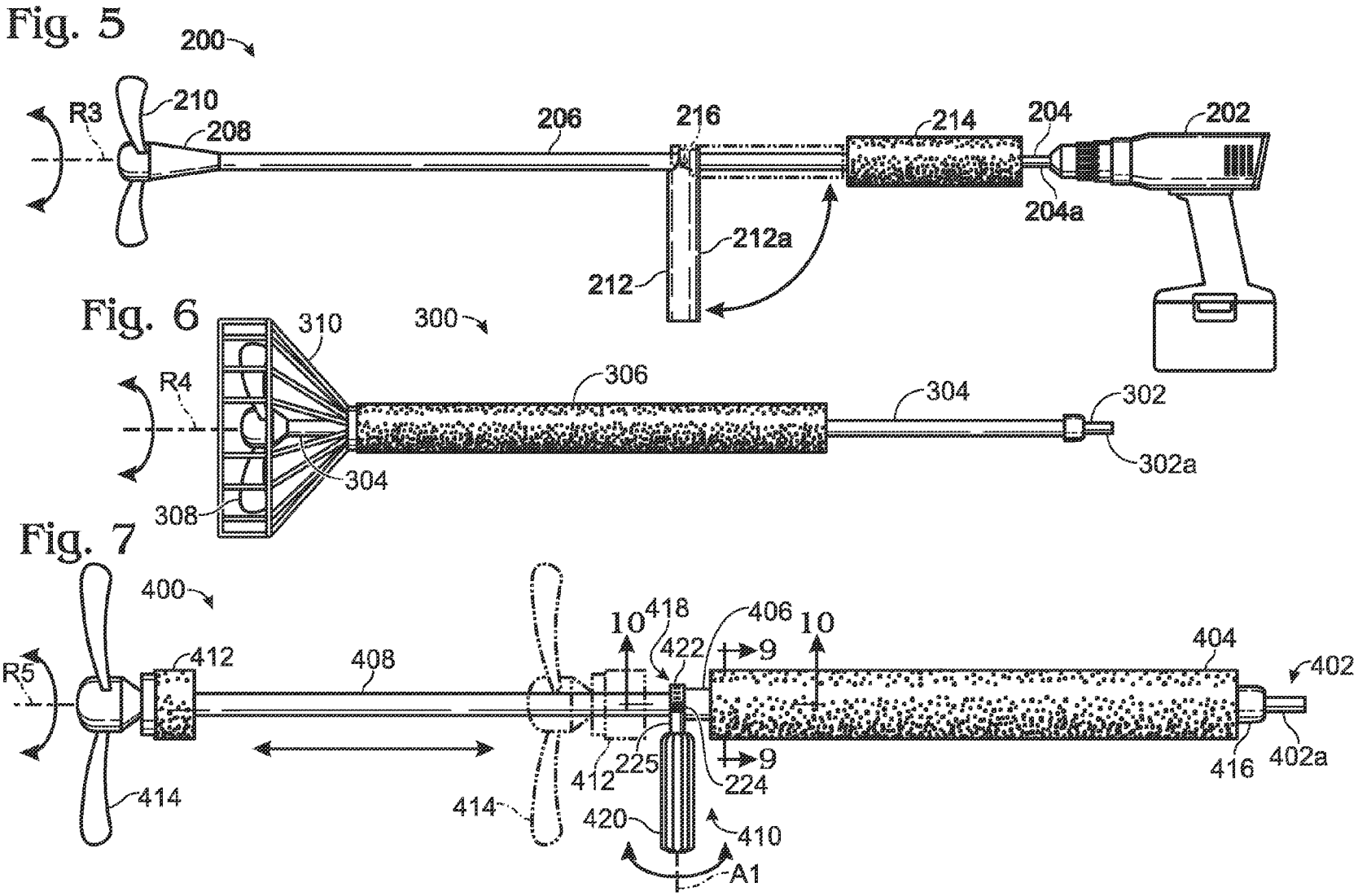
FIG. 5 is an elevation view of an embodiment of a portable propulsion system including a collapsible brace.
FIG. 6 is an elevation view of an embodiment of a portable propulsion system including a prop guard.
FIG. 7 is an elevation view of a telescoping portable propulsion system operable between an extended position (shown in solid lines) and a collapsed position (shown in dash double dot lines).

FIG. 5 shows an embodiment of a portable propulsion system, generally indicated at 200, according to aspects of the present disclosure. As shown, system 200 includes a driver 202, a shaft 204, an outer casing 206, a prop funnel 208, a propeller 210, a brace 212, and a first component 214.

System 200 may be configured to allow driver 202 to be selectively operationally removably connected to propeller 210. For example, shaft 204 may be a straight shaft having a rotational axis R3 extending from a drive end portion 204*a* of shaft 204 to a prop end portion of shaft 204 fixedly secured to propeller 210. Driver 202 may be removably connected to drive end portion 204*a* of shaft 204, and may be configured to rotate propeller 210 about rotational axis R3 via shaft 204 to propel a watercraft. Prop funnel 208 may be configured to reduce drag that may be caused by propeller 210.

Outer casing 206 may be configured to allow shaft 204 to rotate therein without substantially hindering rotation of shaft 204 about axis R3. Outer casing 206 may protect the user from being harmed by rotation of shaft 204, and may provide a surface on which to connect brace 212.

As shown, brace 212 may be a collapsible brace operable between an extended position (shown in solid lines) and a collapsed position (shown in dash double dot lines). The extended position may correspond to an elongate direction of collapsible brace 212 extending substantially perpendicular to rotational axis R3. In the extended position, the user may abut a surface 212*a* of collapsible brace 212 against an exterior surface of the watercraft, and a propulsive force provided by propeller 210 may be transferred to the watercraft via brace 212 (e.g., by brace 212 pressing against the exterior surface of the watercraft).

The collapsed position may correspond to collapsible brace 212 pivoted toward drive end portion 204*a* about a pivot axis 216. Pivot axis 216 may be substantially perpendicular to rotational axis R3 (e.g., FIG. 5 shows pivot axis 216 as being normal to the view of FIG. 5, and rotational axis R3 as being parallel to the view of FIG. 5). In the collapsed position, the elongate direction of brace 212 may be substantially aligned with rotational axis R3. For example, first and second elongate portions of brace 212 may be positioned on opposing sides of outer casing 206 in the collapsed position. The collapsed position may increase the portability of system 200.

In other words, brace 212 may be configured to swing or collapse into a position in which a longitudinal axis of brace 212 is substantially aligned with a longitudinal axis of shaft 204 and a longitudinal axis of outer casing 206. This collapsible configuration of brace 212 may reduce costs related to shipping and may make it easier to store and/or transport portable propulsion system 200.

First component 214 may be similar to first component 42 of system 30 (see FIGS. 1-3). For example, first component 214 may be made of a compressible, water-buoyant material, such as a polymeric closed-cell foam.

FIG. 6 shows an embodiment of a portable propulsion system, generally indicated at 300, according to aspects of the present disclosure. System 300 may include a straight shaft 302, an outer casing 304, a first component 306 disposed around outer casing 304, a propeller 308, and a prop guard 310.

Shaft 302 may include a drive end portion 302*a* configured to receive a driver. A prop end portion of shaft 302 may extend through outer casing 304 to propeller 308. The prop end portion of shaft 302 may be operatively connected to propeller 308, such that rotation of drive end portion 302*a* (e.g., by the driver) may be configured to rotate propeller 308 about a rotational axis R4.

Prop guard 310 may be connected to outer casing 304 and disposed around propeller 308 to prevent propeller 308 from contacting, cutting, and/or puncturing a portion of the watercraft (e.g., an inflatable portion), and/or contacting relatively hard surfaces (e.g., soil and/or rocks on the bottom of a body of water).

First component 306 may be made of a similar material as first component 42 of system 30 (see FIG. 1-3). As shown, first component 306 is disposed between propeller 308 and drive end portion 302*a* of shaft 302, and is disposed closer to propeller 308 than drive end portion 302*a*.

FIG. 7 shows an embodiment of a portable propulsion system, generally indicated at 400, according to aspects of the present disclosure. As shown, system 400 is a telescoping system including a shaft (generally indicated at 402), a first component 404, an outer casing including first and second outer casing portion 406 and 408, a clamping mechanism (generally indicated at 410), a second component 412, and a propeller 414.

First and second components 404 and 412 may be similar in structure and operation as first and second components 42 and 44 of system 30 (see FIGS. 1-3). However, a telescoping operation of system 400 may allow the user to easily alter a separation distance (or a length of a gap) between first and second components 404 and 412.

Shaft 402 may be operatively connected to propeller 414 to propel a watercraft. For example, drive end portion 402*a* of shaft 402 may be dimensioned to selectively receive (or be removably connected to) a driver. Shaft 402 may extend through a hole in an end cap 416 secured to first outer casing portion 406. Shaft 402 may extend through first and second casing portions 406 and 408. A prop end portion 402*b* (see FIG. 8) of shaft 402 opposite drive end portion 402*a* may be fixedly secured to propeller 414. Shaft 402 may have a rotational axis R5 (see FIG. 7) extending from prop end portion 402*b* (see FIG. 8) to drive end portion 402*a* of shaft 402. The driver may be configured to rotate propeller 414 by rotating shaft 402 about rotational axis R5 to displace water and propel the watercraft.

As indicated in FIG. 7, system 400 may be operable between an extended position (shown in solid lines) and a collapsed position (shown in dash double dot lines) along rotational axis R5. The extended position may correspond to the prop end portion of shaft 402 being further away (e.g., further disposed from) drive end portion 402*a* than when in the collapsed position. In other words, the extended position may correspond to system 400 extended along rotational axis R5, and the collapsed position may correspond to system 400 collapsed along rotational axis R5.

System 400 may have any suitable overall length in the extended position, and any suitable overall length in the collapsed position. For example, system 400 may have an overall length of about 72 inches in the extended position, and an overall length of about 36 inches in the collapsed position. In some embodiments, system 400 may have an overall length of about 48 inches in the extended position, and an overall length of about 24 inches in the collapsed position.

System 400 may be configured to rotate propeller 414 about axis R5 in both the extended and collapsed positions, which may increase a level versatility and/or convenience of system 400. For example, the user may desire to propel a relatively small watercraft (e.g., an inflatable tube) with system 400 in the collapsed position, whereas the user may desire to propel a larger watercraft (e.g., a 15-foot boat) with system 400 in the extended position.

The collapsed position of system 400 may provide for system 400 to be more easily carried or stowed on the watercraft or in a backpack, for example.

Operating system 400 between the extended and collapsed positions may involve second casing portion 408 sliding in first outer casing portion 406. For example, in the extended position only an edge portion of second outer casing portion 408 may be disposed inside first outer casing portion 406, and operating system 400 from the extended position toward the collapsed position may involve second outer casing portion 408 sliding further into (e.g., inside of) first outer casing portion 406.

Operating system 400 from the collapsed position toward the extended position may involve a portion of second casing portion 408 sliding out of first outer casing portion 406.

Clamping mechanism 410 may be operable between a released position and a clamped position. The released position may be configured to allow system 400 to move between the extended and collapsed positions. The clamped position may be configured to prevent system 400 from moving between the extended and collapsed positions (or between any other desirable positions between the extended and collapsed positions).

Clamping mechanism 410 may include any suitable device, apparatus, and/or structure for selectively securing system 400 in the extend position, the collapsed position, and/or any suitable position between the extended and collapsed positions. For example, clamping mechanism 410 may include a hose or pipe clamp (generally indicated at 418) connected to a handle 420. In some embodiments, clamping mechanism 410 may be a TURN-KEY® clamp (part no. 5Y01258) made by Ideal Clamp Products, Inc.

Handle 420 have any suitable dimensions. For example, a distal end portion of handle 420 may have a width that is substantially wider than a proximal portion of handle 420.

Pipe clamp 418 may include a strap 422 having a plurality of recesses. Strap 422 may surround an exterior perimeter of first outer casing portion 406. A threaded member 224 of pipe clamp 418 may extend through a housing 225 of pipe clamp 418. Housing 225 may be fixedly secured to a portion of strap 422. Threaded member 224 may be connected to handle 420. Handle 420 may extend along an axis A1 that is substantially perpendicular to rotational axis R5.

Handle 420 may be configured to operate clamping mechanism 410 between the released and clamped positions. For example, operating clamping mechanism 410 from the released position to the clamped position may involve the user rotating handle 420 in a first direction (e.g., in a right hand direction about axis A1). Rotation of handle 420 in the first direction may cause threaded member 424 to pull one or more of the plurality of recesses and a portion of strap 422 toward housing 225 to tighten a circuit formed in strap 422 around first outer casing portion 406, which may tighten first outer casing portion 406 onto second outer casing portion 408 and prevent the outer casing portions from sliding relative to one another.

Operating clamping mechanism 410 from the clamped position to the released position may involve the user rotating handle 420 in a second direction opposite the first direction. Rotation of handle 420 in the second direction may cause threaded member 424 to push the one or more recesses and the portion of strap 422 away from housing 225 to loosen the circuit formed in strap 422 around first outer casing portion 406, which may loosen first outer casing portion 406 around second outer casing portion 408 and allow the outer casing portions to slide relative to one another.

As shown in FIG. 7, first component 404 may be foam tubing disposed around first outer casing portion 406 between handle 420 and a region proximal drive end portion 402*a* of shaft 402.

Figures 8, 9:
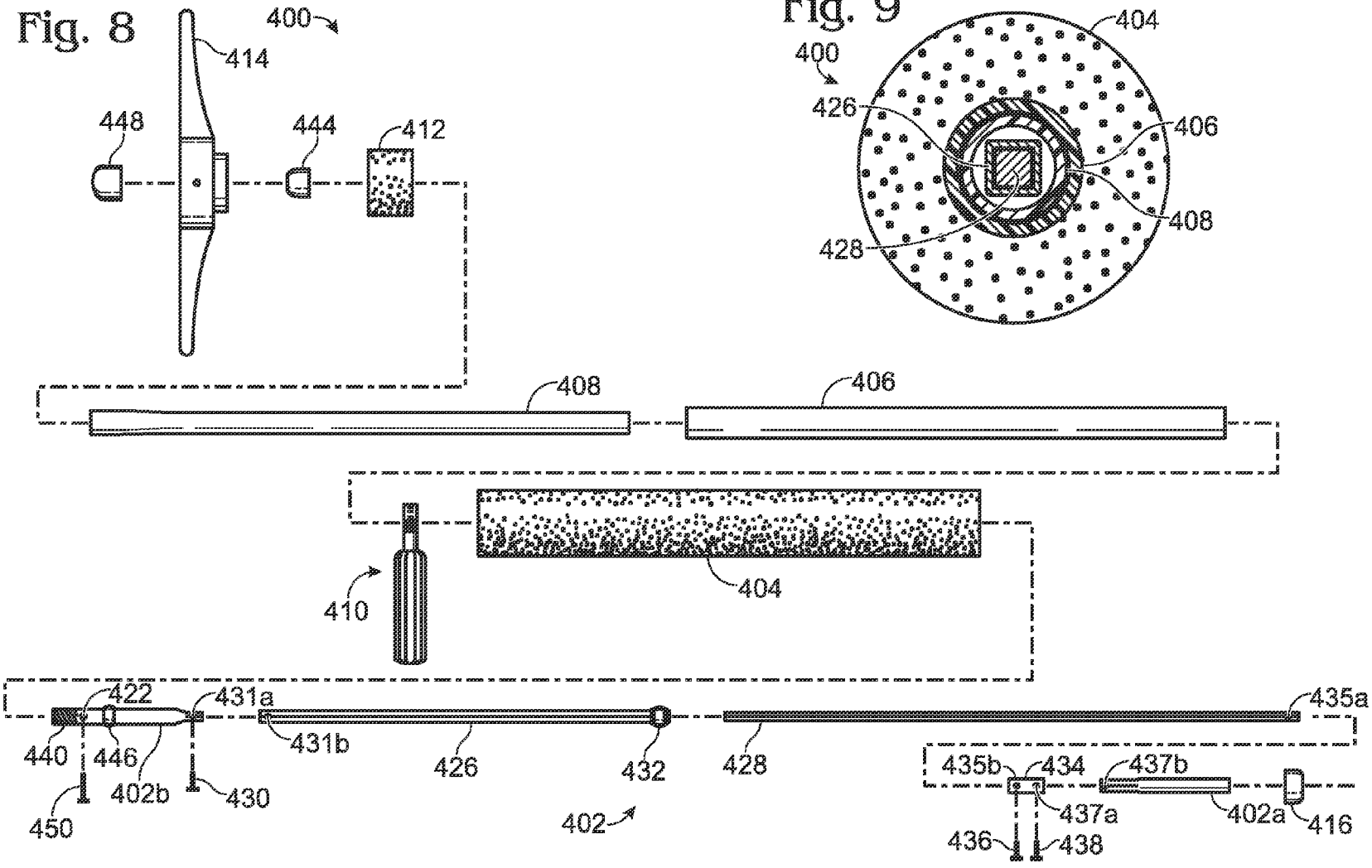
FIG. 8 is a partially exploded view of the telescoping portable propulsion system.
FIG. 9 is a cross-section of the telescoping portable propulsion system taken along the line 9-9 in FIG. 7.

FIG. 8 shows a partially exploded view of system 400. Shaft 402 may include an elongate sleeve 426 and an elongate bar 428. Elongate sleeve 426 may be connected to prop end portion 402*b*. For example, a tapered portion of drive end portion 402*b* may be inserted into an end of sleeve 426 to align respective apertures 431*a* and 431*b*. A pin 430 may be secured in aligned apertures 431*a* and 431*b* to secure sleeve 426 to drive end portion 402*b*. A bushing 433 (see FIG. 11) similar to bushing 432 (e.g., a segment of poly tubing) may be disposed over a region of shaft 402 corresponding to pin 430 after pin 430 has been secured in the aligned apertures.

Elongate bar 428 may be connected to drive end portion 402*a*. For example, bar 428 may be connected to drive end portion 402*a* by a sleeve 434 and pins 436 and 438. For example, bar 428 may be inserted into sleeve 434 to align respective apertures 435*a* and 435*b* of bar 428 and sleeve 434. Pin 436 may be secured in aligned apertures 435*a* and 435*b* to secure bar 428 to sleeve 434. A tapered portion of drive end portion 402*a* may be inserted into an opposite end of sleeve 434 to align respective apertures 437*a* and 437*b* of sleeve 434 and drive end portion 402*a*. Pin 438 may be secured in aligned apertures 437*a* and 437*b* to secure sleeve 434 to drive end portion 402*a*.

Outer casing portions 406 and 408 may be disposed around shaft 402, and first component 404 may be disposed around outer casing portion 408. In other words, shaft 402 may extend through outer casing portions 406 and 408, and outer casing portion 408 may extend through first component 404. In some embodiments, first component 404 may be positioned over end cap 416.

A threaded portion 440 and an aperture 442 of prop end portion 402*b* of shaft 402 may extend through a hole in an end cap 444. End cap 444 may be secured to an end of second outer casing portion 408. A water fitting 446 may be disposed inside second outer casing portion 408 and/or end cap 444. In some embodiments, second component 412 may be disposed over end cap 444.

Prop end portion 402*b* may extend through propeller 414, and an attachment member 448 may be secured to threaded portion 440. Pin 450 may be secured in aperture 442 and secured in a recess of propeller 414 to fixedly secure propeller 414 relative to prop end portion 402*b* of shaft 402.

Shaft 402 may be a telescoping shaft configured to rotate about rotational axis R (see FIG. 7) relative to the outer casing (e.g., first outer casing portion 406 and second outer casing portion 408) in the extended position, the collapsed position, and any position between the extended and collapsed positions. For example, sleeve 426 may have a hollow non-circular cross-section, which is shown in FIG. 9 to be a square-shaped cross-section. The hollow non-circular cross-section of sleeve 426 may be configured to receive and frictionally engage a non-circular cross-section of bar 428 (shown in FIG. 9 to be a correspondingly square-shaped cross-section). Operating system 400 between the extended and collapsed positions may involve square-shaped elongate bar 428 sliding in square-shaped hollow elongate sleeve 426.

In other embodiments, sleeve 426 and bar 428 may have other non-circular cross-sectional shapes (e.g., oval, rectangular, star-like, or other polygonal shapes). For example, bar 428 may have a triangular cross-section, and sleeve 426 may have a correspondingly shaped hollow triangular cross-section adapted to engage bar 428.

FIG. 9 is a cross section of system 400 taken along the line 9-9 in FIG. 7. As shown in FIG. 9, first component 404 extends around the exterior perimeter of first outer casing portion 406, an exterior perimeter of second outer casing portion 408 is received within an interior perimeter of first outer casing portion 408, sleeve 426 is disposed inside second outer casing portion 408, and the square-shaped cross-section of bar 428 is engaged in the hollow square-shaped cross-section of sleeve 426.

As shown in FIG. 9, system 400 may be configured to provide a gap between sleeve 426 and second casing portion 408. Bushing 432 (see FIG. 8) connected to sleeve 426 may be dimensioned to substantially fill the gap, substantially center shaft 402 in second casing portion 408, and promote rotation of shaft 402 about the rotational axis relative to second casing portion 408.

Figure 10:
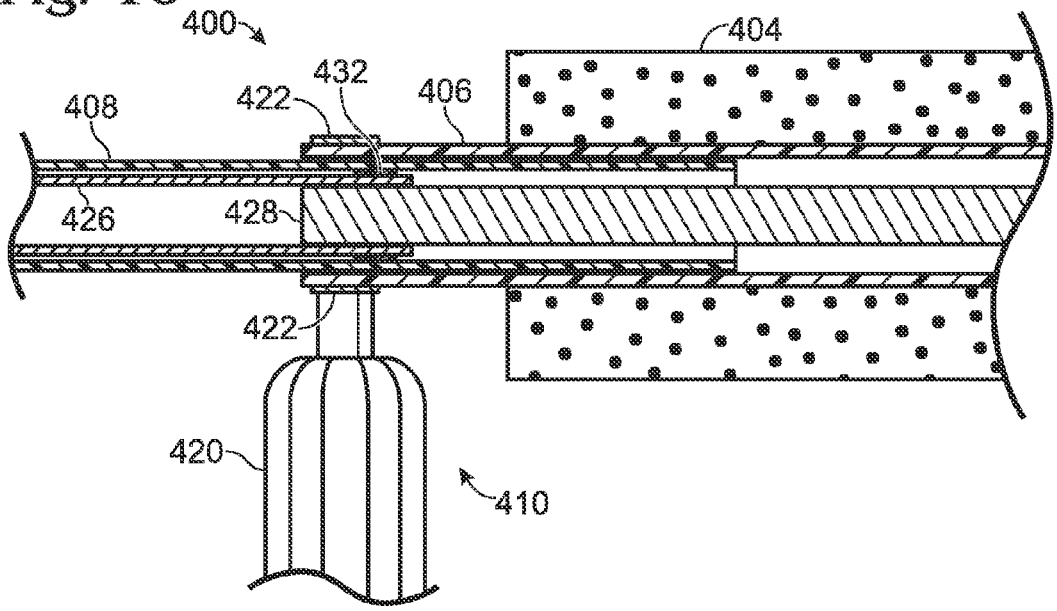
FIG. 10 is a cross-section taken along the line 10-10 in FIG. 7 showing a portion of the telescoping portable propulsion system in the extended position and a clamping mechanism in a released position.

FIG. 10 is a cross-section of system 400 in the extended position taken along the line 10-10 in FIG. 7, with clamping mechanism 410 rotated about rotational axis R5 in FIG. 7 in order to show handle 420 in the view of FIG. 10.

FIG. 10 shows clamping mechanism 410 in the released position. As previously described, in the released position the user may operate system 400 between the extended and collapsed positions, which may involve sleeve 426 and second outer casing portion 408 sliding in first outer casing portion 406 to effectively shorten and lengthen an overall length of system 400.

As shown in FIG. 10, in the extended position, only an end portion of second outer casing 408 extends into first outer casing portion 406, and only an end portion of bar 428 extends into sleeve 426. In other words, in the extended position, only an end portion of first outer casing portion 406 extends over second outer casing portion 408, and only an end portion of sleeve 426 extends over bar 428.

Bushing 432 may be sized to allow the shaft to rotate relative to second outer casing portion 408 in both the released and clamped positions of clamping mechanism 410. For example, the clamped position of clamping mechanism 410 may slightly narrow an internal diameter of second outer casing portion 408, and bushing 432 may have a diameter that is slightly narrower than the narrowed internal diameter of second outer casing portion 408.

Figure 11:
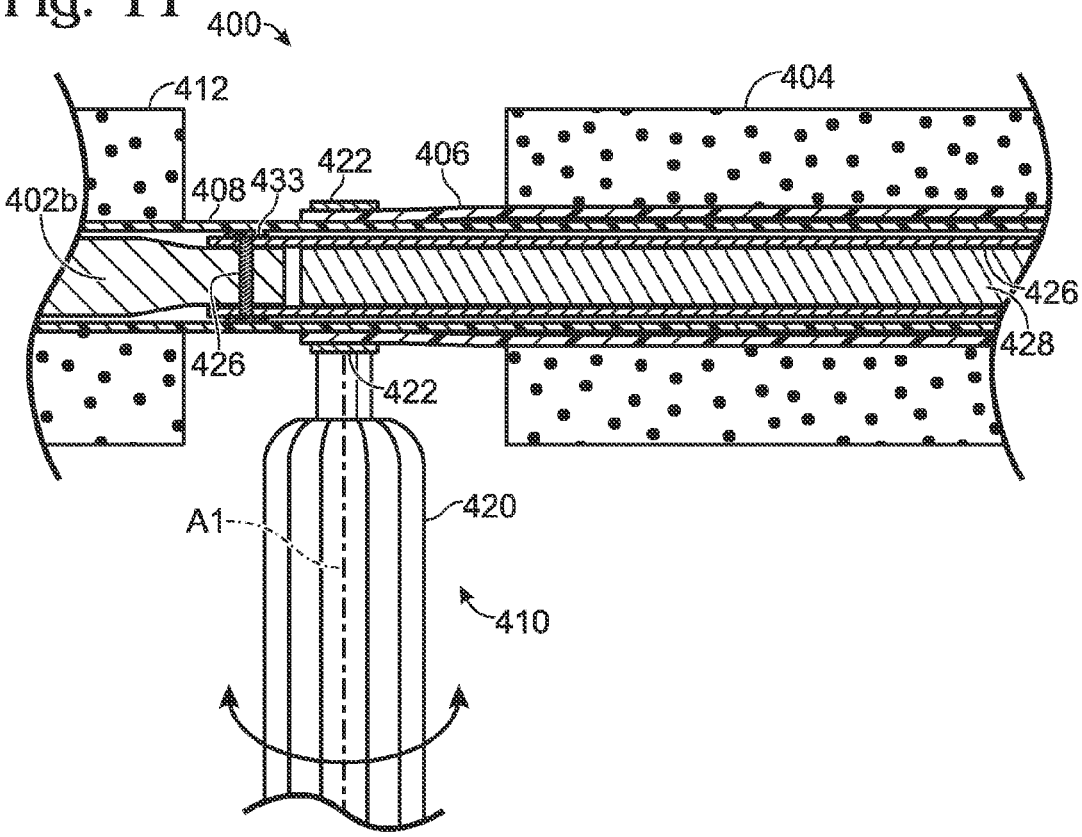
FIG. 11 is a cross-section taken along the line 10-10 in FIG. 7 showing a portion of the telescoping portable propulsion system in the collapsed position and the clamping mechanism in a clamped position.

FIG. 11 is a cross-section of system 400 in the collapsed position taken along the line 10-10 in FIG. 7, with clamping mechanism rotated about rotational axis R5 in FIG. 7 in order to show handle 420 in the view of FIG. 11.

FIG. 11 shows clamping mechanism 410 in the clamped position with handle 420 rotated about axis A1 to tighten the circuit of strap 422 around first outer casing 406, which as a result may tighten a portion of first outer casing 406 around a portion of second outer casing 408, as shown. Rotating handle 420 in an opposite direction about axis A1, may be configured to loosen the circuit in strap 422 to return clamping mechanism 410 to the open position shown in FIG. 10.

As shown in FIG. 11, in the collapsed position, second outer casing portion 408 extends further into first outer casing portion 406 than when in the extended position. In some embodiments, second outer casing portion 408 may abut end cap 416 (see FIGS. 7 and 8) in the collapsed position.

In the collapsed position, bar 428 may extend further into sleeve 426 than when in the extended position. As shown in FIG. 11, in the collapsed position, bar 428 extends through sleeve 428 to a prop end portion of sleeve 428 proximal prop end portion 402*b* of the shaft. In some embodiments, bar 428 may abut prop end portion 402*b* of the shaft in the collapsed position.

Some embodiments of a portable propelling system, according to aspects of the present disclosure, can also be described as follows.

A portable propelling system for propelling a watercraft, comprising a driver operatively connected to a proximal end of a straight shaft having a main axis of rotation; a solar panel connected to the driver; and a propeller operatively connected to a distal end of the straight shaft, such that rotation of the propeller about the main axis propels the watercraft.

In some embodiments, the driver may be a portable cordless electric drill. In other embodiments, the driver may be a rechargeable power-head.

A portable propelling system for propelling a watercraft, comprising a power-head operatively connected to a proximal end of a straight shaft having a main axis of rotation; and a propeller operatively connected a distal end of the straight shaft, such that rotation of the prop about the main axis propels the watercraft.

A portable propelling system for propelling a watercraft, comprising a driver operatively connected to a proximal end of a straight shaft having a main axis of rotation; an outer casing configured to allow the straight shaft to rotate therein without substantially hindering rotation of the straight shaft about the main axis, and to provide a level of buoyancy such that the portable propelling system floats when dropped in water; and a propeller operatively connected to a distal end of the straight shaft, such that rotation of the prop about the main axis propels the watercraft.

The system may further comprise a brace pivotally connected to the outer casing. The brace may be configured to push against the watercraft and to allow a user to pivot the straight shaft side-to-side and up-and-down, wherein the user may selectively collapse the brace, such that a long axis of the brace is substantially parallel to the main axis of rotation.

In some embodiments, the driver may be a gas powered power-head. In other embodiments, the driver may be a portable handheld electric drill having a battery connected to a solar panel.

The outer casing may include an oar, wherein the straight shaft is configured to rotate inside of the oar.

The disclosure set forth above encompasses multiple distinct inventions with independent utility. While each of these inventions has been disclosed in a preferred form or method, the specific alternatives, embodiments, and/or methods thereof as disclosed herein are not to be considered in a limiting sense, as numerous variations are possible. The present disclosure includes all novel and non-obvious combinations and subcombinations of the various elements, features, functions, properties, methods and/or steps disclosed herein. Similarly, where any disclosure above recites "a" or "a first" element, step of a method, or the equivalent thereof, such disclosure should be understood to include one or more such elements or steps, neither requiring nor excluding two or more such elements or steps.

Inventions embodied in various combinations and subcombinations of features, functions, elements, properties, steps and/or methods may be recited in claims of a related application. Such claims, whether they focus on a different invention or the same invention, and whether different, broader, narrower, or equal in scope to the original claims, are also regarded as included within the subject matter of the present disclosure.

What is claimed is:

1. A portable propulsion system for a watercraft, comprising:

a shaft having a prop end section, a drive end section, and a rotational axis extending from the prop end section to the drive end section;

a driver;

a propeller coupled to the driver, the propeller being associated with the shaft and connected to the prop end section, and wherein the drive end section is configured for removable connection to the driver to facilitate rotation of the propeller via rotation of the shaft about the rotational axis to propel the watercraft;

an outer casing disposed around the shaft;

a flexible strap having a first end section and a second end section, the first end section being connectable to the outer casing in a first region distal the drive end section of the shaft, the second end section being coupled to the outer casing in a second region proximal the drive end section of the shaft;

wherein the first end section of the strap is operable between a connected position and a towing position, the connected position corresponding to the first end section of the strap being connected to the outer casing in the first region to form a circuit in the portable propulsion system, the towing position corresponding to the first end section being disconnected from the outer casing in the first region for connection to the watercraft;

wherein the first end section of the strap includes an adjustable first loop;

wherein the first loop surrounds the outer casing in the first region when the first end section is in the connected position;

wherein moving the first end section of the strap from the connected position to the towing position involves loosening the first loop, and sliding it from the first region to the second region and over the drive end section of the shaft;

wherein the second end section of the strap is coupled to the outer casing in the second region when the first end section of the strap is in at least one of the connected and towing positions;

further comprising foam disposed around the outer casing, the foam extending between the first and second regions; and wherein the second loop is sandwiched between the outer casing and the foam.

2. The system of claim 1, wherein the foam has opposing first and second edge sections, with the first edge section being proximal the first region and the second edge section being proximal the second region, the second loop being sandwiched between the outer casing and the second edge section, the first loop being disposed between the outer casing and the first edge section when in the connected position.

3. A portable propulsion system for a watercraft, comprising:

a shaft having a prop end section, a drive end section, and a rotational axis extending from the prop end section to the drive end section;

a propeller connected to the prop end section of the shaft, the drive end section being configured for removable connection to a driver for rotation of the propeller via rotation of the shaft about the rotational axis to propel the watercraft;

an outer casing disposed around the shaft;

a flexible strap having first and second end sections connected to the outer casing in respective first and second regions;

further comprising a first section of foam disposed on the outer casing and extending between the first and second regions; and wherein the second end section of the strap is sandwiched between the first section of foam and the outer casing in the second region.

4. The system of claim 3, wherein the strap is configured to press against the first section of foam.

5. The system of claim 4, wherein the strap is configured to continuously contact the first section of foam between the first and second regions.

6. The system of claim 5, wherein the strap is operable between a narrow-circuit position and a wide-circuit position, the narrow-circuit position corresponding to the strap continuously contacting the first section of foam between the first and second regions, the wide-circuit position corresponding to the strap pulled away from a central section of the first section of the foam disposed between the first and second regions to widen a circuit formed by the strap and the outer casing.

* * * * *